United States Patent [19]

Falasconi

[11] Patent Number: 4,823,659

[45] Date of Patent: Apr. 25, 1989

[54] HOLDER FOR A PANEL CUTTING PLATE

[75] Inventor: Roland Falasconi, Pointe Claire, Canada

[73] Assignee: Rofalex International Inc., Canada

[21] Appl. No.: 11,587

[22] Filed: Feb. 6, 1987

[30] Foreign Application Priority Data

Nov. 3, 1986 [CA] Canada ..... 522052

[51] Int. Cl.[4] ..... B26D 7/18; B26D 1/62

[52] U.S. Cl. ..... 83/100; 83/152; 83/346; 83/670; 83/698; 493/60; 493/342; 493/370; 493/471

[58] Field of Search ..... 83/152, 100, 669, 665, 83/346, 347, 698, 670; 493/60, 342, 471, 370

[56] References Cited

U.S. PATENT DOCUMENTS

| | | | |
|---|---|---|---|
| 642,220 | 1/1900 | Green | 83/98 X |
| 3,106,121 | 10/1963 | Novick | 83/669 X |
| 3,257,885 | 6/1966 | Hornung | 83/669 X |
| 3,578,761 | 5/1971 | Sarka | 493/60 X |
| 3,709,077 | 1/1973 | Trogan et al. | 83/152 |
| 3,850,059 | 11/1974 | Kang | 83/669 X |
| 4,020,724 | 5/1977 | Quinlan | 493/60 |
| 4,537,588 | 8/1985 | Ehlscheid et al. | 493/342 |

*Primary Examiner*—Donald R. Schran
*Attorney, Agent, or Firm*—Larson and Taylor

[57] ABSTRACT

The invention relates to a cutting tool and a tool holder for cutting panels from blanks of sheet-like material. The cutting tool comprises a thin cutting plate on which is formed by etching a cutting edge having a contour corresponding to the outline of the panels to be cut out. The cutting plate also comprises a plurality of openings which are surrounded by the cutting edge. The tool holder is a metallic cylinder to be mounted on the drive shaft of a conventional panel cutting apparatus and comprises a seat for receiving the cutting plate which is retained in the seat by keys. In the cylinder are formed passageways communicating with a source of vacuum and also communicating with the openings on the cutting plate to create a zone of vacuum in the vicinity of the cutting edge.

17 Claims, 2 Drawing Sheets

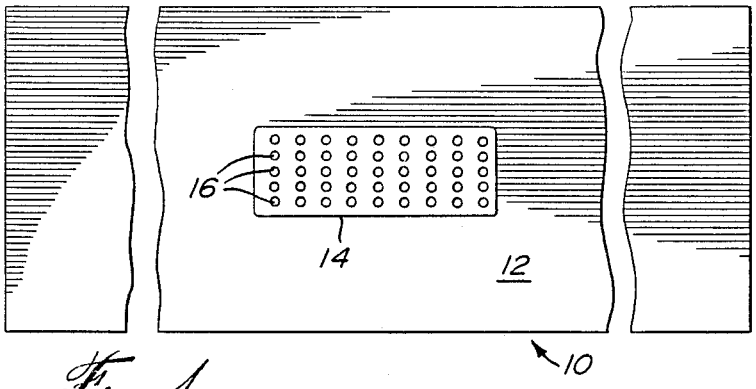
Fig. 1
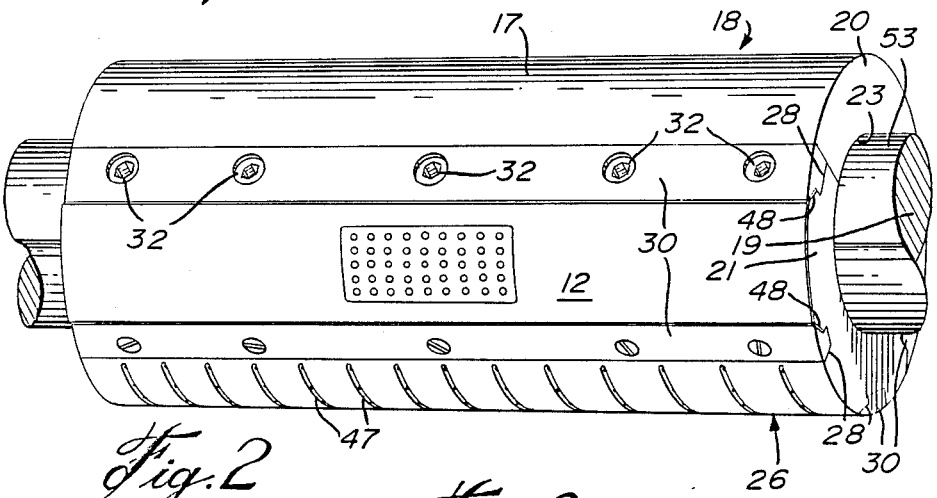
Fig. 2
Fig. 3
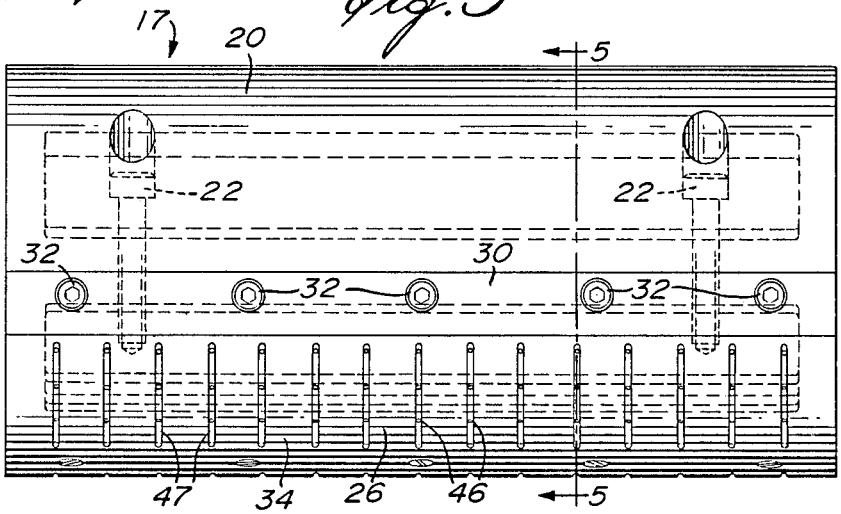

HOLDER FOR A PANEL CUTTING PLATE

FIELD OF THE INVENTION

The present invention relates to the art of cutting panels from blanks of sheet-like material such as paper blanks for producing window envelopes. More specifically, the invention comprehends an improved cutting tool for performing the panel cutting operation and an improved holder for the cutting tool.

BACKGROUND OF THE INVENTION

Envelopes with a transparent panel or window for allowing a visual inspection of the enclosure are well known and widely used.

Window envelopes are manufactured from a web of paper material which is initially cut into blanks having a predetermined shape. Then, a panel is cut from each blank by a panel cutting apparatus to form the window before carrying out the finishing steps of the manufacturing operation such as folding the blanks, gumming, printing and packaging.

Prior art panel cutting apparatuses use a rotary cutter comprising a cutting tool in the form of a massive cutting die and a rotary die holder to bring the cutting die successively in engagement with the envelope blanks which advance in serial order on a conveyor.

The die holder is a metallic cylinder mounted for rotation on a drive shaft synchronized with the conveyor so that, at each revolution of the die holder, the cutting die engages a different envelope blank.

The cutting die and the die holder are provided with small passages in register with an orifice on the drive shaft which communicates through a cavity, formed in the drive shaft, with a source of vacuum. The purpose of this arrangement is to allow a localized vacuum zone to be formed in the vicinity of the cutting die in order to retain to the cutting die and carry away the panels which are cut out from the blanks.

Typically, the drive shaft is provided with a plurality of orifices at different locations thereon to accept die holders of various types and sizes. The vacuum supply to each orifice is controlled by means of valves by the operator of the panel cutting apparatus who selects the orifice to which vacuum is to be applied and shuts off the vacuum to all the other orifices.

On the drive shaft on which is mounted the die holder are also mounted a pair of rubber rollers engaging the blanks while the cutting die cuts out the panels to maintain registration accuracy.

The prior art panel cutting apparatuses suffer from numerous drawbacks, the most acute being the lack of adjustability of the apparatus to cut out panels of different sizes as well as at different locations on the blank. In most cases, from one production run to another, it is necessary to use different cutting dies and, consequently, different die holders. The cutting dies and the die holders are expensive parts since they require an extensive machining work to be fabricated. Also, the installation of the cutting die and the die holder on the panel cutting apparatus requires long and fastidious adjustments resulting in a loss of production time.

OBJECTS AND STATEMENT OF THE INVENTION

An object of the invention is an improved cutting tool for cutting serially panels from blanks of sheet-like material.

Another object of the invention is an improved holder for a panel cutting tool used for serially cutting panels from blanks of sheet-like material.

The objects of this invention are achieved by providing a panel cutting tool in the form of a thin metallic cutting plate on which is formed by etching a cutting edge having a contour corresponding to the outline of a panel to be cut. The cutting plate is also provided with a series of small openings, surrounded by the cutting edge, and through which vacuum is applied for retaining and carrying away the panel cut out from the blank.

The cutting plate, according to the present invention is manufactured by a method similar to the photoengraving process, known in the art of printing. Basically, a metallic plate having a thickness of approximately one sixteenth of an inch is coated with a chemical sensitive to light. The plate is then covered with a mask leaving exposed only the area on which the cutting edge is to be formed. After subjecting the plate to light rendering the chemical acid-resistant, the plate is dipped into an acid bath for a certain period of time. The acid dissolves the plate at the non-exposed areas to form the cutting edge.

For carrying out the panel cutting operation, the cutting plate is mounted on a cylindrical plate holder which, in a preferred embodiment of the invention, is of such design to accept cutting plates of different sizes. With this arrangement, in most cases, to set the panel cutting apparatus for a new production run, only the cutting plate needs to be changed.

The plate holder is provided with a seat for receiving the cutting plate which is retained therein by means of keys clamping opposite edges of the cutting plate. In a specific embodiment, the seat extends about half the circumference of the cylindrical holder and is provided with four keys dividing the seat in three portions, each portion being bound by two adjacent keys. With such an arrangement, the seat may receive plates of three different lengths. However, it is plain that more or less than four keys may be used on the holder.

The cutting plate and the holder define a rotary cutter which is adapted to be mounted on a conventional panel cutting apparatus. Toward this end, the holder is provided with a central cavity for receiving the drive shaft of the panel cutting apparatus. In the walls defining the central cavity are formed individual vacuum chambers in the form of depressions or recesses, each vacuum chamber being associated with a portion of the seat. Each vacuum chamber communicates with a respective portion of the seat by small air passages and also communicates with a vacuum supply orifice on the drive shaft.

The operator of the panel cutting apparatus may select the portion of the seat at which vacuum will be applied by controlling the vacuum supply at the orifices of the drive shaft and supplying vacuum only in the desired vacuum chamber.

Therefore, the present invention includes in a general aspect a rotary cutter for serially cutting panels from blanks of sheet-like material, the rotary cutter comprising:

a thin metallic cutting plate on which is formed integrally a cutting edge having a contour corresponding to the outline of a panel to be cut, the cutting plate further comprising opening means formed on an area on the cutting plate which is edged by the cutting edge; and a holder for the cutting plate, the holder being adapted to be mounted on a driving shaft for rotation about an axis in order to bring successively in engagement the cutting plate with the blanks to cut serially panels therefrom, the driving shaft including an orifice communicating through a conduit means with a source of vacuum, the holder including:

(a) a seat for receiving the cutting plate;

(b) clamping means for retaining the cutting plate in the seat; and (c) passageway means extending between the seat and the orifice when the holder is mounted on the shaft for creating a zone of vacuum in the vicinity of the cutting edge, wherein when the cutting edge engages a blank and cuts a panel therein, the vacuum zone retains the panel to the cutting plate.

The present invention further comprises a holder for a thin metallic cutting plate adapted to cut serially panels of sheet-like material, on the cutting plate being formed integrally a cutting edge having a contour corresponding to the outline of a panel to be cut, the cutting plate further comprising opening means formed on an area on the cutting plate which is edged by the cutting edge, the holder being adapted to be mounted on a driving shaft for rotation about an axis in order to bring the cutting plate successively in engagement with the blanks to serially cut panels therefrom, the driving shaft including an orifice communicating with a source of vacuum through a conduit means, the holder being generally elongated and comprising a cavity which is adapted to receive the shaft, the holder including:

(a) a seat adapted to receive the cutting plate;

(b) clamping means for retaining the cutting plate in the seat; and (c) passageway means extending between the seat and the orifice when the holder is mounted on the driving shaft in order to create a zone of vacuum in the vicinity of the opening means, wherein when the cutting plate engages a blank to cut a panel therefrom, the zone of vacuum retains the blank to the cutting plate which carries the panel away from the blank.

The invention also comprehends a thin metallic cutting plate for serially cutting panels from blanks of sheet-like material, the cutting plate comprising a cutting edge integrally formed on the cutting plate, the cutting edge having a contour corresponding to the outline of a panel to be cut, the cutting plate further comprising opening means formed on an area on the cutting plate, the area being edged by the cutting edge, the opening means being adapted to be connected to a source of vacuum to create a zone of vacuum in the vicinity of the opening, the cutting plate being adapted to move successively in engagement with the blanks to serially cut panels therefrom, wherein when the cutting plate cuts a panel from a blank the vacuum zone retains the panel to the cutting plate.

BRIEF DESCRIPTION OF THE DRAWINGS

FIG. 1 is an elevational view on an enlarged scale of a panel cutting tool in the form of cutting plate;

FIG. 2 is a holder for a cutting plate according to the invention, the cutting plate being mounted on the holder and defining therewith a rotary cutter;

FIG. 3 is an elevational view of a holder for the cutting plate shown in FIG. 2, the cutting plate being omitted;

DESCRIPTION OF A PREFERRED EMBODIMENT

Figure 4:
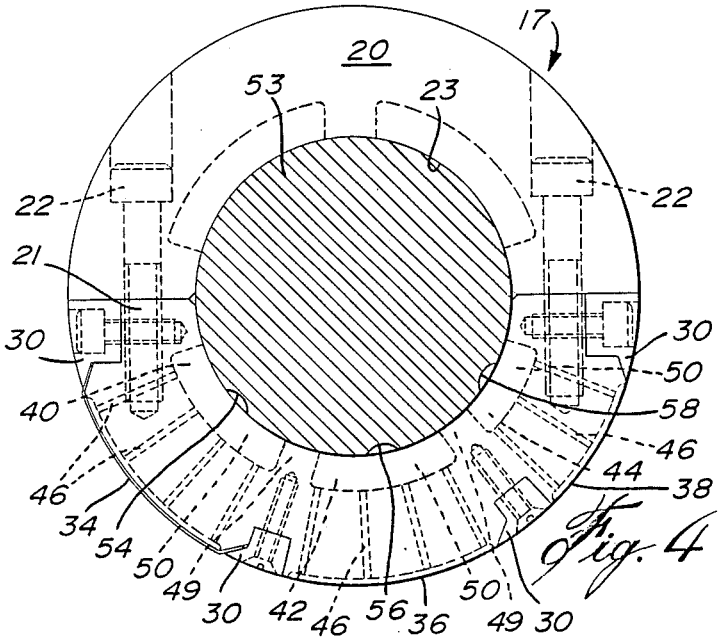
FIG. 4 is a side view of the holder shown in FIG. 2.

Referring now to the drawings, more particularly to FIG. 1 in which is illustrated a cutting tool, designated generally by the reference numeral 10, for serially cutting panels from envelope blanks of paper. The cutting tool comprises a metallic cutting plate 12 having approximately a thickness of one sixteenth of an inch. On cutting plate 12 is formed integrally a continuous cutting edge 14 having a contour corresponding to the outline of a panel to be cut, which in this particular case has a rectangular configuration with rounded corners. It should be understood, however, that cutting edges with different shapes may be formed on cutting plate 12.

The cutting plate 12 also comprises a plurality of openings 16 which are surrounded by the cutting edge 14. The purpose of the openings 16, as it will be explained in details hereinafter is to allow a zone of vacuum to be formed in the vicinity of the cutting edge 14 to retain the panel which is cut from each blank, to the cutting plate and carry away the panel from the blank.

For carrying out the cutting operation, the cutting plate 12 is mounted on a rotary cutting plate holder 17, shown in FIG. 2, the cutting plate 12 and the plate holder 17 defining a rotary cutter 18. The rotary holder 17 extending along an axis 19 has a cylindrical shape and is formed by two halves 20 and 21 attached to each other by bolts 22. Halves 20 and 21 define a central cavity 23.

More specifically, referring to FIGS. 2 to 5, the outer surface of half 21 defines a semi-cylindrical seat 26 for receiving the cutting plate 12. On the seat 26 are formed four grooves 28 extending along the axis 19, each groove receiving a key 30 which is retained therein by means of screws 32. Each key 30 is biased by two coil springs (not shown) compressed between the key 30 and its respective groove 28 to eject the key 30 from the groove 28 when the screws 32 are released.

On the surface of seat 26, the ends of passages 46 are interconnected by shallow circumferentially extending grooves 47.

The seat 26 is divided in three portions 34, 36 and 38, respectively, each portion being bound between two adjacent keys. Portions 34, 36 and 38 of the seat 26 communicate with respective and independent vacuum chambers 40, 42 and 44 by means of small air passages 46 uniformly distributed substantially over the entire surface of the seat 26. The vacuum chambers 40, 42 and 44 open in the central cavity 23.

Each vacuum chamber is constituted by a depression or a recess formed in the inner walls of half 21 and is separated from an adjacent vacuum chamber by a partition 49. The vacuum chambers 40, 42 and 44 are closed at each end of the plate holder 17 by end walls 50.

To mount the cutting plate 12 on the holder 17, two opposite edges 48 of the cutting plate 12 are clamped by two keys 30 on the seat 26, as shown in FIG. 2. The specific structure of the holder shown in FIGS. 2 to 4 is such as to accept plates of three different lengths. More specifically, for applications where the panel to be cut is small, a short cutting plate 12 will be used. In such case, the cutting plate will extend only over the portion 34 of the seat 26.

When the panel to be cut has a surface exceeding the surface of portion 34, a cutting plate 12 of intermediate length may be used. In such case, the cutting plate will overlie portions 34 and 36. At last, where extremely large panels are to be cut out a long cutting plate is mounted on holder 17, extending over the entire surface of seat 26.

It should be understood that more or less than four keys may be provided on the seat 26 without departing from the spirit of the invention. For example, for applications where panels of one size are cut most of the time, only a pair of keys may be provided on the holder 17 to retain only single sized cutting plates.

On the contrary, in situations when during each production run only small quantity of envelopes are produced and the size as well as the location of the window on the envelope varies from one production run to another, it is preferable to employ a cutting plate holder of more universal design, which can accept plates of different sizes.

Figure 5:
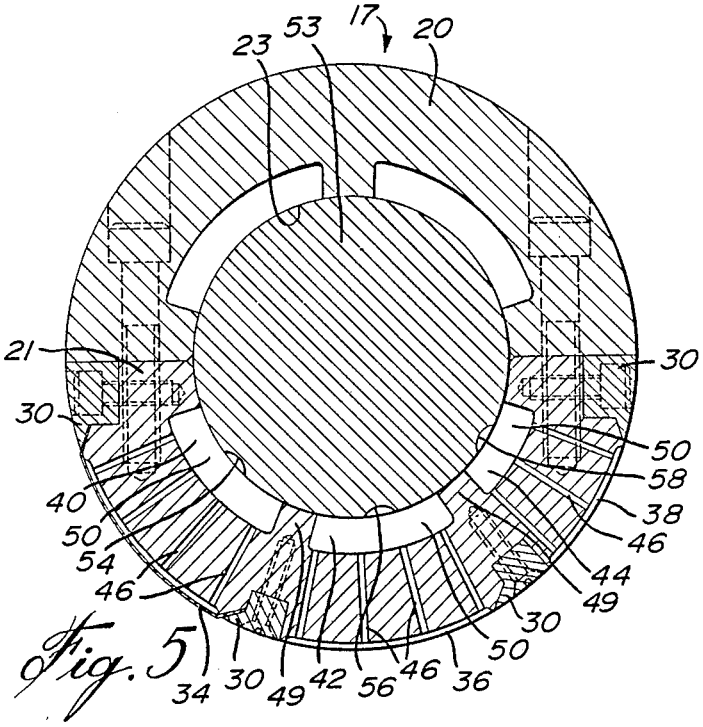
FIG. 5 is a sectional view taken on lines 5—5 of FIG. 3.

The rotary cutter 18 is adapted to be installed on a conventional panel cutting apparatus. An example of such apparatus is given in the U.S. Pat. No. 3 106 121 granted to A. Novick on Oct. 8, 1963. Basically, the panel cutting apparatus comprises a conveyor to move in serial order to the envelope blanks to a cutting station where the rotary cutter cuts out the panels. The rotary cutter is mounted on a drive shaft, which is schematically illustrated in FIGS. 2, 4 and 5 and is designated by the reference numeral 53.

The drive shaft 53 is provided with three orifices 54, 56 and 58 communicating with vacuum chambers 40, 42 and 46, respectively. The orifices 54, 56 and 58 also communicate with an internal conduit (not shown) in the drive shaft connected to a source of vacuum. The vacuum supply to each orifice may be controlled by means of valves by the operator of the apparatus. Thus, according to the length of the cutting plate 12 to be used, the operator may apply vacuum only to the desired orifice and the associated vacuum chamber to create a vacuum zone in the desired portion of the seat 26.

For example, when a short cutting plate 12 is used, which occupies only the portion 34 of seat 26, vacuum will be applied only to orifice 54 to create a suction on the surface in the portion 34 only. Similarly, when a cutting plate 12 of intermediate length is used vacuum is applied to orifices 54 and 56 and when a long cutting plate 12 is mounted in seat 26, vacuum is supplied in all the orifices. When the cutting plate 12 is mounted on the cutting plate holder 17, the suction created on the back of the cutting plate 12 allows, to form a localized vacuum zone in the vicinity of the openings 16.

During the panel cutting operation, when the cutting edge 14 engages and cuts out a panel, the local vacuum zone retains the panel to the cutting plate 12 and the panel is carried away from the blank. When the cutting edge has travelled to a position away from the blank, the vacuum is shut-off and the panel is blown into a waste basket.

The vacuum control system of the panel cutting apparatus which enables to control the vacuum supply to the orifices 54, 56 and 58 and which also shuts-off the vacuum to release the cutted panel in the waste basket, will not be described in details here since it is well known in the art.

The rotary cutter 18, according to this invention, apart from its ease of adjustability to cut out different panels has some other advantages over the prior art rotary cutters. A first advantage resides in the elimination of the rubber rollers used to engage the envelope blanks to ensure registration accuracy during the cutting of the panels. The cutting plate 12 being relatively thin, the rotary cutter 18 has a smooth overall shape and thus, it may be used as a roller to advance and maintain the blanks in the proper position during the cutting operation.

A second advantage resides in the possibility of improving the productivity of the panel cutting apparatus by increasing the speed of rotation of the rotary cutter, which is possible because the cutting plate 12 is light and the rotary cutter 28 is generally well balanced. Thus, it may be rotated at higher speeds without overstressing the bearings of the drive shaft on which it is mounted.

The panel cutting plate 12 is manufactured by a method similar to the photoengraving process used to produce intaglios.

The first step for manufacturing the cutting plate 12 consists of making a mask or screen constituted by a film which is opaque over the major portion of its surface except at locations where the cutting edge is to be formed. The position and the size of the transparant zone on the mask is determined according to the size and the location of the window on the envelope. Subsequently, the mask is applied to a metallic plate which is coated with a substance sensitive to light. After an exposure to a light source, which renders the light sensitive substance at the transparant zone of the mask corrosive-resistant, the plate is dipped into a corrosive bath, such as acid for a period of time sufficient to etch away the non-exposed areas of the plate and form a suitable projecting cutting edge.

The above description of a preferred embodiment of the invention should not be interpreted in any limiting manner and it should be understood that it may be modified and refined in various ways without departing from the spirit of the invention. The scope of the invention is defined in the annexed claims.

I claim:

1. A rotary cutter for cutting panels from sheet-like material, said rotary cutter comprising:

a thin metallic cutting plate on which is formed integrally a cutting edge having a contour corresponding to the outline of a panel to be cut, said cutting plate further comprising opening means formed on an area on said cutting plate which is edged by said cutting edge; and a holder for said cutting plate, said holder being adapted to be mounted on a driving shaft for rotation about an axis to bring successively in engagement said cutting plate with said sheet-like material, said holder including:

(a) a seat for receiving said cutting plate, said seat being divided into a plurality of portions;

(b) a plurality of vacuum chambers adapted to communicate each with a source of vacuum, each vacuum chamber being associated with a respective portion of said seat, and communicating therewith by a plurality of passageways for creating a zone of vacuum in the vicinity of said opening means to retain a panel cut from said sheet-like material to said cutting plate; and (c) clamping means for retaining said cutting plate in said seat, said clamping means including a plurality of spaced apart keys, to retain said cutting plate in said seat, two opposite edges of said cutting plate being clamped by two keys, each portion of said seat being bound by two adjacent keys.

2. A rotary cutter as defined in claim 1, wherein said holder is generally cylindrical and comprises a central cavity adapted to receive said driving shaft, said cavity being bound by walls in which are formed a plurality of depressions defining said vacuum chambers, said driving shaft including a plurality of orifices each communicating with a vacuum chamber.

3. A rotary cutter as defined in claim 2, comprising four keys.

4. A rotary cutter as defined in claim 2, wherein said keys extend about said axis.

5. A rotary cutter as defined in claim 1, wherein each portion comprises a plurality of orifices distributed over substantially the entire surface of the portion, said plurality of orifices communicating with the vacuum chamber associated with the portion.

6. A holder for a thin metallic cutting plate which is adapted to cut panels from a sheet-like material, said cutting plate comprising a cutting edge integrally formed on said cutting plate, said cutting edge having a contour corresponding to the outline of a panel to be cut, said cutting plate further comprising opening means formed on an area on said cutting plate which is edged by said cutting edge, said holder being adapted to be mounted on a driving shaft for rotation about an axis in order to bring said cutting plate successively in engagement with said sheet-like material, said holder being generally elongated and comprising a cavity which is adapted to receive said shaft, said holder including:

(a) a seat adapted to receive said cutting plate, said seat being divided into a plurality of portions;

(b) a plurality of vacuum chambers each being adapted to communicate with a source of vacuum, each vacuum chamber being associated with a respective portion and communicating therewith by a plurality of passageways for creating a zone of vacuum in the vicinity of said opening means to retain a panel cut from said sheet-like material to said cutting plate; and (c) clamping means for retaining said cutting plate in said seat, said clamping means comprising a plurality of spaced apart keys for clamping opposite edges of said cutting plate.

7. A holder as defined in claim 6, wherein said holder is generally cylindrical and comprises a central cavity adapted to receive said driving shaft, said cavity being bound by walls in which are formed a plurality of depressions defining said vacuum chambers, said driving shaft including a plurality of orifices each adapted to communicate with a vacuum chamber.

8. A holder as defined in claim 7, comprising four keys.

9. A holder as defined in claim 7, wherein said keys extend about said axis.

10. A holder as defined in claim 6, wherein each portion of said seat includes a plurality of orifices distributed over substantially the entire surface of the portion, said pluralit of orifices communicating with the vacuum chamber associated with the portion.

11. A holder for a thin metallic cutting plate for cutting panels from sheet-like material such as paper or the like, said cutting plate being of the type comprising an integrally formed cutting edge contoured to the outline of a panel to be cut, said cutting plate comprising an opening on an area of said cutting plate encompassed by said cutting edge, said holder being generally elongated and comprising a cavity for receiving a shaft adapted to rotate said holder about an axis in order to bring successively in engagement said cutting plate with said sheet-like material, said holder comprising:

(a) a seat adapted to receive said cutting plate;

(b) a plurality of orifices distributed over substantially the entire surface of said seat, said orifices being adapted to communicate with a source of vacuum wherein when said cutting plate is mounted in said seat at least one of said orifices being in fluid communication with said opening to create a zone of vacuum in the vicinity of said opening;

(c) clamping means for retaining said cutting plate in said seat; and (d) said seat being divided into a plurality of portions, said holder further comprising a plurality of vacuum chambers, each being adapted to communicate with a source of vacuum, there being one vacuum chamber associated with each portion of said seat, orifices on each portion communicating with a respective vacuum chamber.

12. A holder, as defined in claim 11, wherein said clamping means comprise spaced apart keys mounted on said holder and bordering said portions.

13. A holder for a thin metallic cutting plate used for cutting panels from a sheet-like material, said cutting plate being of the type comprising a cutting edge integrally formed on said cutting plate, said cutting edge being contoured to the outline of a panel to be cut, said cutting plate further comprising opening means on an area of said cutting plate encompassed by said cutting edge, said holder comprising:

a generally cylindrical body with a centrally located recess extending along a longitudinal axis of said body to receive a drive shaft;

a seat formed on the outer surface of said cylindrical body for receiving said cutting plate, said seat being divided into a plurality of portions;

key means on said cylindrical body for mounting said cutting plate in said seat;

a plurality of independent vacuum chambers within said body, there being one vacuum chamber for each portion of said seat, each vacuum chamber being adapted to communicate with a source of vacuum and also communicating through passageway means with a respective portion of said seat.

14. A holder as defined in claim 13, wherein each portion of said seat comprises a plurality of orifices distributed substantially over the entire surface of the portion and communicating with the vacuum chamber associated with the portion.

15. A holder as defined in claim 14, wherein said key means comprises a plurality of spaced apart keys, each key extending along a longitudinal axis of said cylindrical body.

16. A holder as defined in claim 15, wherein each key extends along an edge of a portion.

17. A holder as defined in claim 13, wherein said vacuum chambers open in said recess.

* * * * *